US006371901B1

(12) United States Patent
Jackson et al.

(10) Patent No.: US 6,371,901 B1
(45) Date of Patent: Apr. 16, 2002

(54) LINEAR FOLDING DEVICE AND METHOD

(75) Inventors: Barry Mark Jackson, York, ME (US); Joseph Adrian St. Ours, Lee; Jatinder Singh Sappal, Dover, both of NH (US)

(73) Assignee: Heidelberger, Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/464,481

(22) Filed: Dec. 15, 1999

(51) Int. Cl.[7] ..... B31B 1/26; B31B 1/58
(52) U.S. Cl. ..... 493/405; 493/423; 493/441
(58) Field of Search ..... 493/397, 405, 493/423, 438, 440, 441, 443

(56) References Cited

U.S. PATENT DOCUMENTS 3,127,165 A * 3/1964 Denny et al. ..... 493/399
4,310,326 A * 1/1982 Bellanca ..... 493/423
4,614,512 A * 9/1986 Capdeboscq ..... 493/441
4,881,933 A * 11/1989 Wech ..... 493/225
4,918,906 A * 4/1990 Ako ..... 53/449
5,030,193 A 7/1991 Breton et al. ..... 493/458
5,997,459 A * 12/1999 Kruger et al. ..... 493/441
6,231,493 B1 * 5/2001 Kato ..... 493/423

* cited by examiner

*Primary Examiner*—Rinaldi I. Rada
*Assistant Examiner*—Hemant M. Desai
(74) *Attorney, Agent, or Firm*—Davidson, Davidson & Kappel, LLC

(57) ABSTRACT

A signature folding device including a first transport device for transporting a first part of a signature, and a second transport device next to the first transport device for transporting a second part of the signature. The second transport device is skewed with respect to the first transport device so as to move the second part of the signature toward the first part of the signature. Also provided is a method for folding a signature including the steps of transporting a first part of the signature in a first direction, and transporting a second part of the signature in a second direction, the second direction being skewed toward the first direction so that a fold begins to form in the signature.

14 Claims, 3 Drawing Sheets

LINEAR FOLDING DEVICE AND METHOD

BACKGROUND OF THE INVENTION

1. Field of the Invention

The present invention relates generally to folders of printing presses and more particularly to a device and method for folding a signature of printed material.

2. Background Information

Web printing presses print a continuous web of material, such as paper. The continuous web is then processed in a folder of the printing press. Folders can provide for particular desired folds in a finished printed product. A cutting unit is typically included to cut the web into individual signatures. Folds often need to be provided both to the web and the signatures which are cut from the web.

U.S. Pat. No. 5,030,193 purports to disclose a folder apparatus which includes a first folder assembly which forms a first fold in a web of sheet material along the path of movement of the sheet material. This first fold is performed by pulling the web over a triangular-shaped stationary folder board and feeding the web through a pair of nip rollers to set the fold. The web is then cut by a cutting cylinder to form signatures, the signatures then being carried by a tucking cylinder to a jaw cylinder. A tucking blade of the tucking cylinder pushed the signature into a set of jaws of the jaw cylinder to create the second fold, which is transverse to the first fold. The signatures are then sent to a third folder assembly having an array of tapes which grip the signatures and move them through the third folder assembly. The array of tapes maintain a straight direction within the third folder assembly. However, two stationary formers at the sides of the tapes accept the sides of the signature as the signature enters the third folder assembly. These formers then converge at an angle to the tapes, so as to force the outer edge portions of the signature upwardly, thereby forming the fold of the third folder assembly.

The first folder assembly of the above-cited patent has the disadvantage that it is difficult or impossible to be used to fold signatures, a web must be pulled over the former board. The second folder assembly has the disadvantage that many moving parts are required. The third folder assembly has the disadvantage that the design is complicated and requires a large number of belts of different length.

In addition, known chopper folding mechanisms often require more than one chopper folder mechanism to support a single printing press running at fall speed. The signature stream thus often must be split and decelerated, which requires auxiliary devices such as diverters, slow down sections and integrators. These auxiliary devices increase the risk of fold inaccuracies, as the signatures must interact with each device and still maintain proper position.

BRIEF SUMMARY OF THE INVENTION

An object of the present invention is to provide for a device and method for folding signatures whereby damage to the printed products may be reduced. An additional or alternative object of the present invention is to provide for a simplified device for folding signatures.

The present invention provides a signature folding device including a first transport device for transporting a first part of a signature, and a second transport device next to the first transport device for transporting a second part of the signature, the second transport device being skewed with respect to the first transport device so as to move the second part of the signature toward the first part of the signature.

Preferably, the first and second transport devices include belts which grip the respective parts of the signature from above and below.

Since the second transport device skews toward the first transport device, the signature between the first part and the second part rises to begin to form a fold.

The folding device may further include a fold guide into which the signature may enter after exiting the first and second transport devices. After exiting the fold guide the folded signature may be carried by a plurality of vertical transport belts.

The folding device also preferably includes vertical nip belts to receive the fold and to aid in setting the fold. The second transport device may include a skewed belt section followed by a straight belt section, the straight belt section preferably being located before a fold guide.

The skewed belt section preferably runs at a slightly higher speed than the first transport device. The first part and the second part of the signature thus can travel in a same direction at the same speed, even while the fold is being created.

The present invention also provides a method for folding a signature including the steps of transporting a first part of the signature in a first direction, and transporting a second part of the signature in a second direction, the second direction being skewed toward the first direction so that a fold begins to form in the signature.

The method further may provide moving the fold into a pair of vertical nip belts. The method also may provide that the signature is moved into a fold guide after the transporting steps.

Preferably, the transporting of the second part occurs at a speed slightly greater than the transporting of the first part.

The transporting steps preferably are accomplished by having belts grip the respective parts of the signature from above and below.

The present invention provides a simplified device and method for folding a signature. The moving parts of the device may be simple belt drives. No complicated mechanisms are required.

Because the fold takes place while both halves of the signature are held securely by the first and second transport devices, it is possible to accomplish accurate high speed folding and to eliminate the need for a chopper mechanism.

BRIEF DESCRIPTION OF THE DRAWINGS

An embodiment of the present invention is described below by reference to the following drawings, in which.

DETAILED DESCRIPTION

Figure 1:
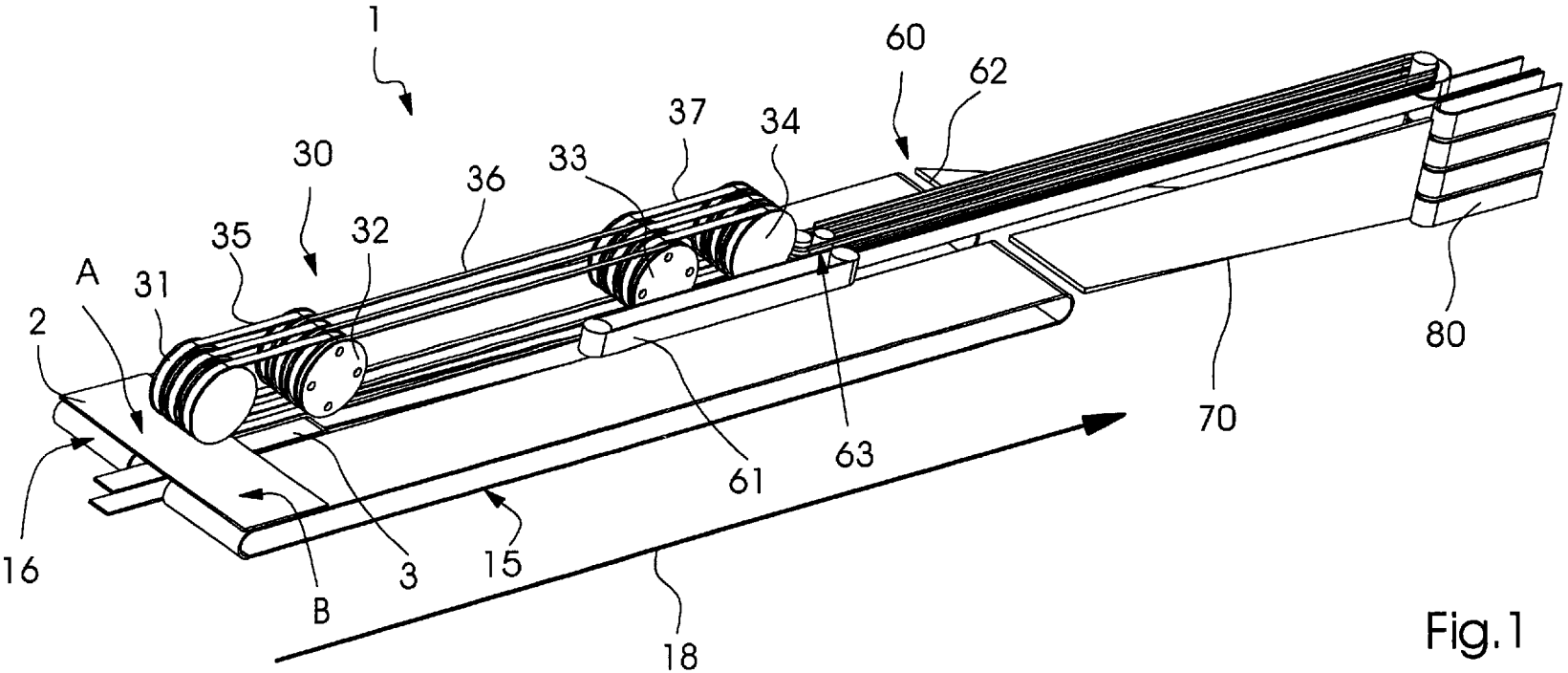
FIG. 1 shows a top perspective view of the device of the present invention, with a belt of the first transport section not shown in order to aid clarity.

FIG. 1 shows a top perspective view of the a folding device 1 for folding a signature 2. Signature 2 is transported by a first belt drive 3 to the folding device 1. Signature 2 is received in folding device 1 by a first transport device 15 and a second transport device 16, so that signature half A is received by second transport device 16 and signature half B by first transport device 15. First transport device 15 travels in the direction of arrow 18.

Figure 2:
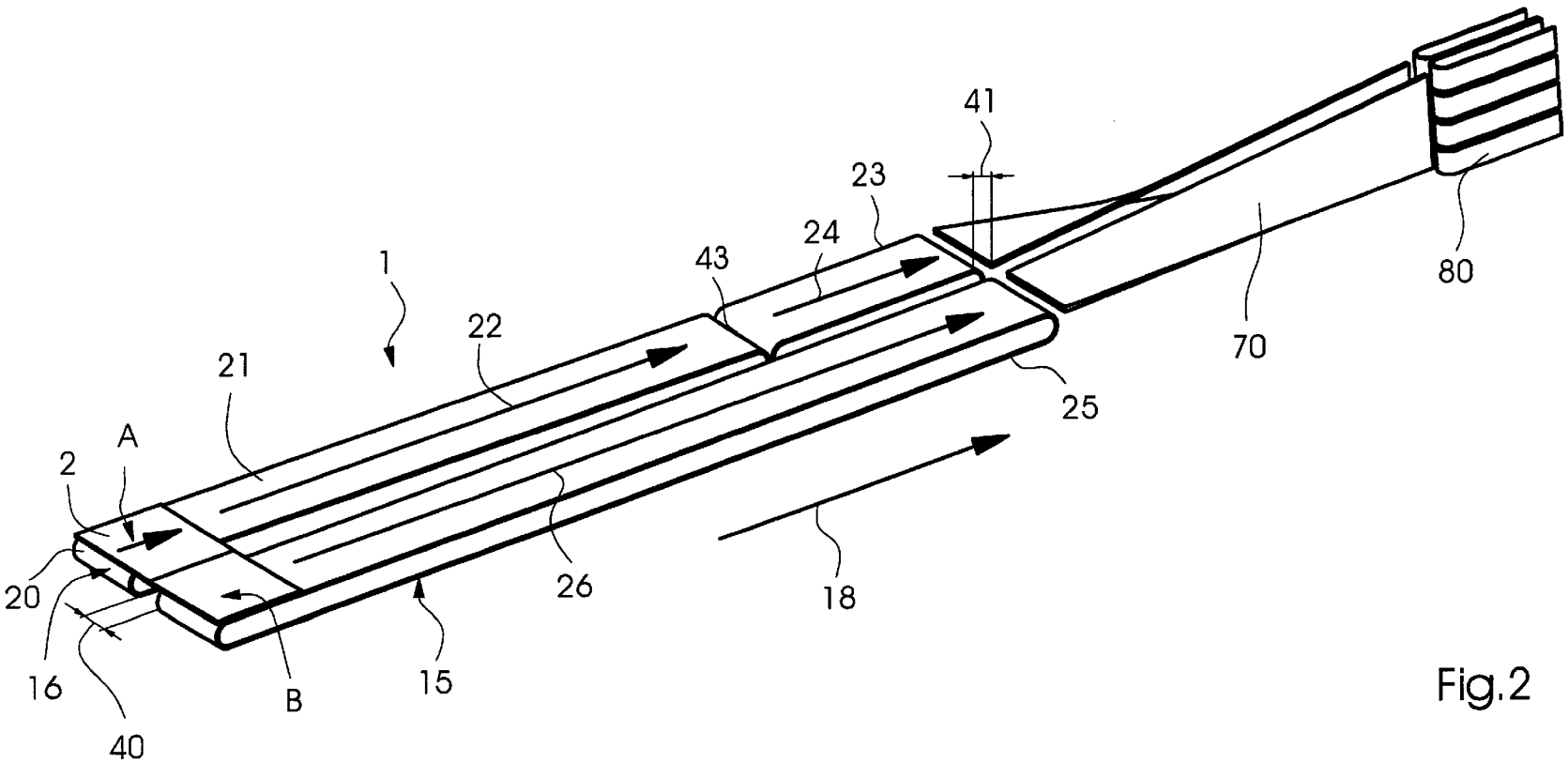
FIG. 2 shows top perspective view of a bottom part of the device of the present invention.

As shown in FIG. 2, which depicts a bottom half of folding device 1, second transport device 16 includes a first straight belt section 20, a lower skewed belt section 21 traveling in the direction of arrow 22, and a second straight belt section 23 traveling in the direction of arrow 24. Arrows 18, 24 and 26 and the direction of belt 20 all are parallel to one another.

First transport device 15 includes a belt 25 which moves in the direction of arrow 26, which is the same as the direction of arrow 18. First transport device 15 also includes a top belt which is not shown to aid clarity. This top belt grips the top of signature part B as signature 2 travels through the first transport device 15. Thus signature part B is firmly held to travel in direction 26.

Second transport device 16 includes, as shown in FIG. 1, a top skewed belt section 30 which includes a first roller 31, a second roller 32, a third roller 33 and a fourth roller 34. Between first and second rollers 31 and 32 are retracting belts 35, between second roller 32 and third roller 33 are intermediate non-retracting belts 36, and between rollers 33 and 34 are further retracting belts 37. All of these belts 35, 36 and 37 are skewed toward the first transport device 15, so that the belts travel in the same direction as lower belt section 21, i.e. in direction 22.

Top belt section 30 is generally located directly above lower belt section 21.

First lower straight belt section 20 is thus located a distance 40 apart from belt 25. As the signature progresses forward on belt section 21 and first transport device 15, signature part A transfers instantly via retracting belts 35 to skewed belt section 21.

Skewed belt sections 21 and 30 then move signature half A toward signature half B, since skewed belt section 21 comes close to belt 25 at location 43. At location 43 the distance between the belts 21 and 25 is less than the distance 40. Second straight belt section 23 is also located a distance 41 away from belt 25, distance 41 preferably being less than distance 40.

Figure 3:
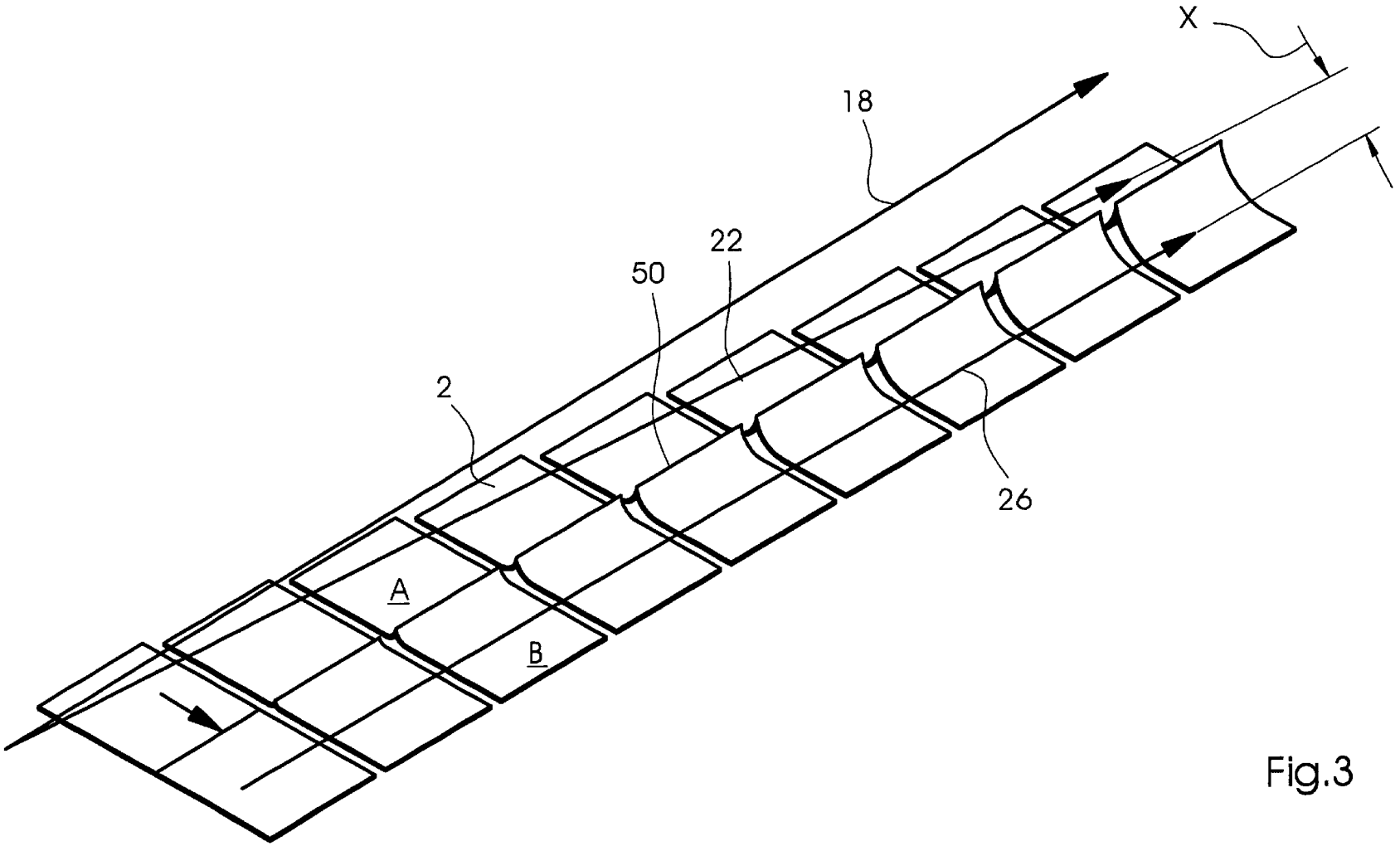
FIG. 3 shows schematically the formation of the fold in the signatures which may result from use of the device of the present invention.

FIG. 3 shows the effect on the signatures 2 of the convergence of transport devices 15 and 16. Part of signature halves B travel in direction 26 within first transport device 15. Part of signature halves A however travel through between skewed belt sections 21 and 30 in direction 22, which is skewed with respect to directions 26 and 18 (which are parallel). Thus a fold 50 results between the two held parts.

All of the belts run on rollers driven by motors. However, the belts sections 21 and 30 run slightly faster than the belt 25, so that the signature half A is transported in direction 18 at the same speed as signature half B is transported in direction 26. If x defines the angle between direction 22 and direction 26 and v is the speed of belt 25, then belts 22 and 30 run at approximately a speed of V/cos x.

Once folds 50 are created, the fold may be set by fold setting device 60, which includes belt 61 and belt 62. Fold 50 can bump against belt 61, which runs at the same speed as belt 25, and be transported into a nip 63 between belt 61 and belt 62. This nip 63 helps to set fold 50. Belts 61 and 62 then transport signature 2 as signature 2 exits first and second transport devices 15 and 16 and enters a former section 70, which here is depicted as a static fold guide. This static fold guide is shaped to complete the fold, so that as signature 2 moves through the fold guide, the shape of the fold guide forces the signature halves A and B together. However, instead of the static fold guide, a dynamic folder roller or folding belts could also be used to complete the fold.

After exiting former section 70, the folded signature may be transported by further transport belts 80.

Although the first and second transport devices have been shown using belts, other types of transport device which provide a firm signature grip, such as a series of tightly spaced roller, could be used. Moreover, the first transport device as defined herein need not be straight or a single device, but may be composed of a first section and a second section at different angles. For example, both transport devices could skew at their second sections toward a central axis. The term "skewed" thus means that one of the transport devices is merely skewed relative to the other transport device.

What is claimed is:

1. A linear folding device comprising:

a first transport device for transporting a first part of a signature; and a second transport device next to the first transport device for transporting a second part of the signature, the second transport device having a first section for transporting the second part of the signature parallel to the first part of the signature and a second section following the first section, the second section being skewed with respect to the first transport device so as to move the second part of the signature toward the first part of the signature.

2. The linear folding device as recited in claim 1 wherein the first transport device includes a moving belt.

3. The linear folding device as recited in claim 1 wherein the second transport device includes a lower belt and an upper belt, both the lower belt and the upper belt being skewed toward the first transport device.

4. The linear folding device as recited in claim 3 wherein the second transport belt includes a belt section traveling in a same direction as the first transport device.

5. The linear folding device as recited in claim 1 further comprising a former section after the first and second transport devices.

6. The linear folding device as recited in claim 5 wherein the former section is a static fold guide.

7. The linear folding device as recited in claim 1 further comprising vertical nip belts to receive a fold formed in the signature.

8. The linear folding device as recited in claim 1 wherein the second transport device has a section which runs at a speed faster than the first transport device.

9. A method for folding a signature comprising:

transporting a first part of the signature in a first direction; and transporting a second part of the signature in a second direction, the second direction being skewed toward the first direction so that a fold begins to form in the signature.

10. The method as recited in claim 9 further comprising setting the fold in a pair of vertical nip belts.

11. The method as recited in claim 9 further comprising moving the signature through a former section after the transporting steps.

12. The method as recited in claim 9 wherein the transporting of the second part occurs at a speed slightly greater than the transporting of the first part.

13. The method as recited in claim 9 wherein the transporting steps are performed using belts.

14. The method as recited in claim 9 further comprising transporting the second part of the signature in a direction parallel to the first direction before the step of transporting the second part of the signature in the second direction.

* * * * *